US008505650B2

(12) United States Patent
Schmitz et al.

(10) Patent No.: US 8,505,650 B2
(45) Date of Patent: Aug. 13, 2013

(54) APPARATUS AND METHOD FOR MAKING BOREHOLES IN THE GROUND, THE CROSS SECTIONS OF WHICH BOREHOLES PARTIALLY INTERSECT

(75) Inventors: Willi Schmitz, Wassenberg (DE); Hermann Josef Von Wirth, Titz (DE)

(73) Assignee: Aker Wirth GmbH, Erkelenz (DE)

( * ) Notice: Subject to any disclaimer, the term of this patent is extended or adjusted under 35 U.S.C. 154(b) by 339 days.

(21) Appl. No.: 12/919,013

(22) PCT Filed: Feb. 16, 2009

(86) PCT No.: PCT/EP2009/051780

§ 371 (c)(1),
(2), (4) Date: Aug. 24, 2010

(87) PCT Pub. No.: WO2009/106448

PCT Pub. Date: Sep. 3, 2009

(65) Prior Publication Data

US 2011/0005833 A1 Jan. 13, 2011

(30) Foreign Application Priority Data

Feb. 25, 2008 (DE) ..... 10 2008 010 773

(51) Int. Cl.
*E21B 7/00* (2006.01)

(52) U.S. Cl.
USPC ..... 175/57; 175/326

(58) Field of Classification Search
USPC ..... 175/326, 408, 325.1, 81, 57; 405/267
See application file for complete search history.

(56) References Cited

U.S. PATENT DOCUMENTS

| | | | |
|---|---|---|---|
| 5,056,242 | A | 10/1991 | Miotti |
| 5,797,465 | A | 8/1998 | Shibasaki et al. |
| 2005/0150692 | A1 | 7/2005 | Ballantyne et al. |
| 2007/0105405 | A1 | 5/2007 | Biserna et al. |

FOREIGN PATENT DOCUMENTS

| | | | |
|---|---|---|---|
| DE | 833 335 | B | 3/1952 |
| DE | 898 724 | B | 12/1953 |
| DE | H 22 087 | | 9/1956 |
| DE | 31 03 336 | A1 | 8/1982 |
| DE | 693 31 552 | T2 | 10/1995 |
| DE | 199 50 040 | A1 | 5/2001 |
| EP | 0 649 716 | A | 4/1995 |
| EP | 1 770 219 | A | 4/2007 |
| FR | 2 852 352 | A | 9/2004 |
| JP | 2007 162337 | | 6/2007 |

OTHER PUBLICATIONS

US 3,557,561, 01/1971, Sherard (withdrawn)

*Primary Examiner* — David Andrews
*Assistant Examiner* — Taras P Bemko
(74) *Attorney, Agent, or Firm* — Norman B. Thot

(57) ABSTRACT

An apparatus for making a second borehole in the ground, a cross section of which second borehole partially intersects a cross section of an existing first borehole, includes a boring device and a guide device operatively connected to the boring device. The guide device includes a first guide element configured to interact with a first side of a wall of the existing first borehole facing the second borehole and a second guide element configured to interact with a second side of the existing first borehole remote from the second borehole. The guide device is configured to guide the boring device relative to the existing first borehole.

15 Claims, 2 Drawing Sheets

SECTION A-B

APPARATUS AND METHOD FOR MAKING BOREHOLES IN THE GROUND, THE CROSS SECTIONS OF WHICH BOREHOLES PARTIALLY INTERSECT

CROSS REFERENCE TO PRIOR APPLICATIONS

This application is a U.S National Phase application under 35 U.S.C. §371 of International Application No. PCT/EP2009/051780, filed on Feb. 16, 2009 and which claims benefit to German Patent Application No. 10 2008 010 773.5, filed on Feb. 25, 2008. The International Application was published in German on Sep. 3, 2009 as WO 2009/106448 A1 under PCT Article 21(2).

FIELD

The present invention relates to an apparatus for making a second borehole in the ground, the cross section of which borehole partially intersects the cross section of an already existing first borehole, with a boring device and with a guide device which is operatively connected to the boring device for guiding the boring device relative to the already existing first borehole, the guide device comprising at least a first guide element which interacts with the wall of the first borehole on the side that faces the second borehole.

The present invention further relates to a method for making boreholes running roughly parallel in the ground, the cross sections of which boreholes partially intersect, with the aid of the apparatus according to the present invention.

BACKGROUND

An above-mentioned apparatus is described in EP 1 770 219 A1. In addition to the first guide elements, this apparatus has second guide elements which abut against the side of the wall of the second borehole that faces the first borehole.

The guide elements accordingly interacting with two boreholes are intended to prevent the boreholes, which partially intersect each other in cross section, from diverging from their mutually parallel direction to the extent that the opening between the boreholes that is generated by the intersection of the cross section is greatly reduced or even disappears altogether. This result of departing from the parallel orientation of adjacent boreholes relative to one another is particularly disadvantageous when the adjacent boreholes belong to a large number of correspondingly made boreholes which, once made, are to be filled out with suitable sealing material, for example concrete, in order to produce an impermeable sealing wall. The reason for this is that if the connecting opening were reduced, the sealing wall would be weakened in an undesired manner; in the case of complete disappearance of the connecting opening, the sealing wall would even be interrupted. The structure, which is often complex to produce, would then not perform its purpose.

Although the apparatus described in EP 1 770 219 A1 is suitable for preventing the second borehole from diverging transversely to the connection plane of the borehole longitudinal axes, this apparatus does not offer reliable protection against the borehole straying from the already existing borehole.

SUMMARY

An aspect of the present invention is to provide an apparatus which can be used to make a more precise second borehole in the ground with regard to its course relative to the position of an already existing borehole, the cross section of which is to be partially intersected.

In an embodiment, the present invention provides an apparatus for making a second borehole in the ground, a cross section of which second borehole partially intersects a cross section of an existing first borehole, which includes a boring device and a guide device operatively connected to the boring device. The guide device includes a first guide element configured to interact with a first side of a wall of the existing first borehole facing the second borehole and a second guide element configured to interact with a second side of the existing first borehole remote from the second borehole. The guide device is configured to guide the boring device relative to the existing first borehole].

BRIEF DESCRIPTION OF THE DRAWINGS

The present invention is described in greater detail below on the basis of embodiments and of the drawings in which.

DETAILED DESCRIPTION

Figure 1A:
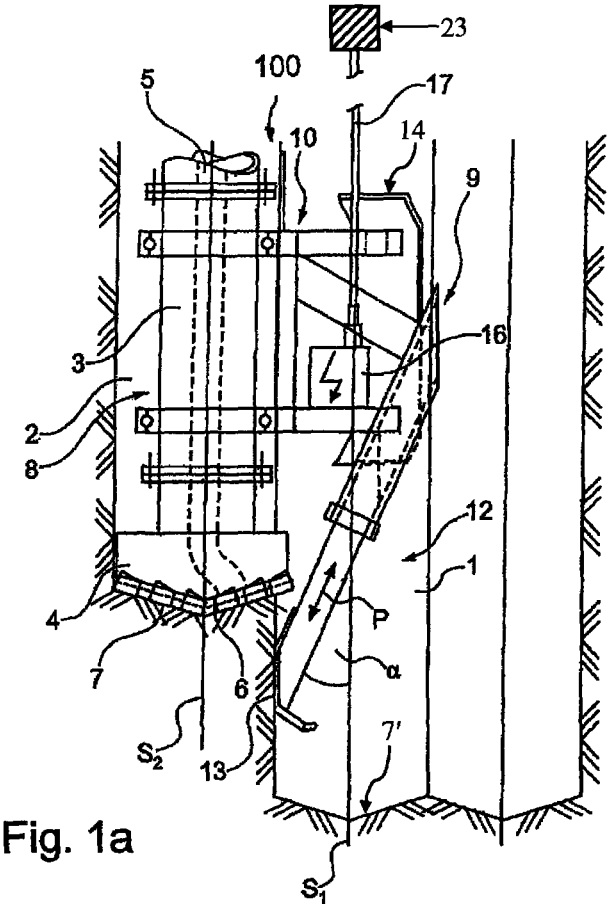
FIG. 1*a*) shows a (schematic) side view of an embodiment of an apparatus according to the present invention during drifting of a second borehole which partially intersects the cross section of a first, adjacent borehole (section A-B in FIG. 1*b*))

As a result of the fact that the apparatus according to the present invention comprises at least one second guide element which interacts with the side of the first borehole that is remote from the second borehole, the boring device is guided exclusively by interaction with the walls of the first borehole. This measure allows the second borehole to be sunk reliably; in particular, the second borehole is prevented from straying toward the first borehole. Furthermore, at least almost the entire volume of the second borehole above the bottom of the borehole is available for the apparatus components known from the prior art which are required for detaching and removing soil, and so maximum drift speeds and thus the best possible building progress can be achieved.

The first guide element can, for example, be configured so as to be suitable for interacting with the first borehole before the bottom of the second borehole, viewed in the drift direction of the second borehole. On account of this measure, the first guide element can abut over a particularly large area against the wall of the first borehole and there is no risk of its guide function being lost as a result of the connecting region between the adjacent boreholes collapsing.

The first guide element can then, for example, be configured so as to abut against the wall of the first borehole on both sides of the plane connecting the longitudinal axes of the first and the second borehole. The abutment on both sides, which can be provided, for example, symmetrically to the plane, prevents the supporting from producing forces which run transversely to the plane which could then exert on the boring device moments directed transversely to the drift direction. On the other hand, if there is a risk of moments of this type on account of other influences, then the abutment of the guide element can be selected so as to be purposefully unsymmetrical to the plane in order to thereby generate inversely directed moments for at least partial compensation.

In order to allow the second borehole to be made just as deep as the first borehole, the first guide element can, for example, be configured to be displaceable in a direction having a direction component parallel to the longitudinal axis of the first borehole.

For this purpose, the first guide element is arranged, for example, at the leading end, viewed in the drift direction, of a length-variable holder. The first guide element can then be retracted as soon as it reaches the bottom of the first borehole, whereupon the second borehole can be drifted further until its bottom lies roughly in the same plane as that of the first borehole.

In order to impart the required properties to the holder, the holder can, for example, be arranged so that its adjustment direction encloses an acute angle with the longitudinal axis of the first borehole. In this case, retracting of the first guide element leads at the same time to the first guide element rising from the borehole wall and also to this extent not presenting an obstacle to the further drifting of the second borehole.

The holder can comprise an electrically, pneumatically or hydraulically operated length adjuster which can be activated when, for example, correspondingly provided sensors ascertain that the first guide element has hit the bottom.

Alternatively, it is likewise possible to provide the holder with a length adjuster to which a spring force is applied and which presses the first guide element against the wall of the first borehole. This variant is distinguished, for example, by its simple and thus cost-effective producibility and its insusceptibility to breakdown.

In an embodiment, the present invention provides for an apparatus comprising a measuring device for detecting the position of the guide device in the first borehole. If this measuring device identifies displacements of the guide device, then these may signal an undesired divergence of the second borehole from the position parallel to the first borehole. Such divergence can be caused, for example, by the boring device obliquely hitting relatively hard ground when the second borehole is sunk. The measuring device thus enables the operator of the apparatus to take suitable countermeasures in the case of a signal of this type.

The measuring device can comprise an electronic inclinometer or else a laser gyro.

If the boring device comprises a rotationally driven boring head and a control device for influencing the rotary drive, then the measuring device can, for example, be operatively connected to the control device. Should the measuring device signal an undesired change in position of the guide device in the first borehole, the rotary drive can be influenced with the aid of the control device so that a backwardly directed force is generated. The direction of rotation in which the boring head is driven can be inverted, for example, in the case of lateral straying from the connecting plane between the first and the second borehole, as forces directed at all times transversely to the connecting plane act on the boring head as a result of the friction of the boring head in the borehole.

Alternatively or additionally, the apparatus can comprise support elements which act on the boring device and which can be brought into abutment with the wall of the second borehole, for example, above the boring device, in directions running transversely to the connecting plane, with the aid of actuating elements. The actuating elements are then for their part connected to a device which is in turn connected to the measuring device. Should the measuring device signal an undesired change in position, it is then possible to automatically bring into abutment with the wall of the second borehole those of the actuating elements that are required for achieving a backwardly directed force.

The presence of a measuring device of this type and the coupling thereof to the control devices of the rotary drive and/or the actuating elements allow the directional course of the second borehole to be actively influenced. The apparatus embodied in this way therefore allows mutually adjacent boreholes which partially intersect in cross section to be made in the ground at a course accuracy which has not been achieved in the past.

The present invention also provides a method for making boreholes running roughly parallel in the ground, the cross sections of which boreholes partially intersect. The method includes the following steps:

a) making a first borehole;

b) making a second borehole with the aid of an apparatus described hereinbefore, wherein the boring device is guided by interaction of the guide device only on the wall of the first borehole.

If the boring device used in the method is rotationally driven, the direction of the rotary drive for generating a moment acting in the return pivot direction can, for example, be altered while the guide device pivots about the longitudinal axis of the first borehole.

Alternatively or additionally, as the guide device pivots about the longitudinal axis of the first borehole, a force acting in the return pivot direction can be generated by a support element which acts on the boring device and is pressed against the wall of the second borehole.

The apparatus, which is denoted in its entirety by 100 in FIG. 1, comprises a boring rod assembly 3 which is rotationally driven with the aid of a rotary drive (not shown in the drawings) about the longitudinal axis S2 thereof which coincides with the longitudinal axis of the borehole 2 to be made, which will be referred to hereinafter as the "second borehole." At the leading end, in the borehole-making direction, shown at the bottom in FIG. 1*a*), a boring head 4, which is rotated with the boring rod assembly 3, is arranged on the boring rod assembly 3. A channel 5 (indicated by broken lines in FIG. 1*a*), the leading end of which, as viewed in the borehole-making direction, opens out into the end face 6 of the boring head 4, is located inside the boring rod assembly 3. Soil which is detached at the bottom 7 of the borehole is conveyed outward through the channel 5, for example with the aid of the known "reverse circulation" method in which air is pumped into a water column standing in the channel 5 and a flow is thus generated upward into the channel 5 according to FIG. 1*a*).

Figure 1B:
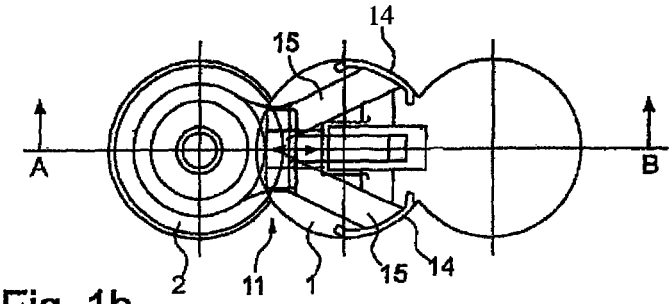
FIG. 1*b*) shows a (schematic) view from above of the same apparatus.

As may be seen in particular from FIG. 1*b*), the second borehole 2 is made in the ground in such a way that its cross section intersects the cross section of a previously made first hole 1 (shown in FIG. 1 on the right-hand side next to the borehole 2).

In order for the longitudinal axis S2 of the second borehole to run parallel to the longitudinal axis S1 of the first borehole, the boring device, which comprises the boring rod assembly 3 and the boring head 4 and is denoted in its entirety by 8, is operatively connected to a guide means which is denoted in its entirety by 9. For this purpose, the boring rod assembly 3 is stationarily provided, in a segment above the boring head 4, as shown in FIG. 1*a*), in the direction of the longitudinal axis S2 relative to the boring rod assembly 3, with a carrier 10 extending through the opening 11 formed on account of the intersection of the first and the second borehole 1, 2.

A holder 12 is attached to the carrier 10. The holder is embodied in several parts so that its length can be adjusted in the direction of the arrow P with the aid of a pneumatic cylinder (not shown in the drawings).

As may be seen from FIG. 1*a*), the adjustment direction encloses an acute angle α with the longitudinal axis S1.

The leading end, in the borehole-making direction, of the holder 12 carries a first guide element 13 which abuts, when the holder 12 is extended, below the bottom 7 of the borehole, against the side of the wall of the first borehole 1 that faces the second borehole 2. The length adjustability of the holder 12 allows the second borehole 2 to be made in the ground just as deep as the first borehole 1 in that the first guide element 13 is displaced back during the last boring advance as soon as the first guide element touches the bottom 7' of the first borehole 1.

Second guide elements 14, which are fastened to the carrier 10 of the guide device 9 with the aid of rigid extension arms 15, serve to further support the guide device 9 on the wall of the first borehole 1. The extension arms 15 and the second guide elements 14 are configured so that the guide elements abut in a planar manner against the wall of the first borehole in the region pointing away from the second borehole, as is illustrated schematically in FIG. 1*b*).

A measuring device 16, by means of which changes in position of the guide device 9 can be detected and which is connected via signal lines 17 to a control device 23 for influencing the rotary drive (likewise not shown in the drawings) for the boring rod assembly, is arranged on the guide device 9. The measuring device 16 and the control device 23 are adapted to each other so that, in the case of signals suggesting an undesired change in position, the control device 23 influences the drive device in such a way that forces counteracting the change in position are generated in the second borehole 2.

Figures 2A, 2B:
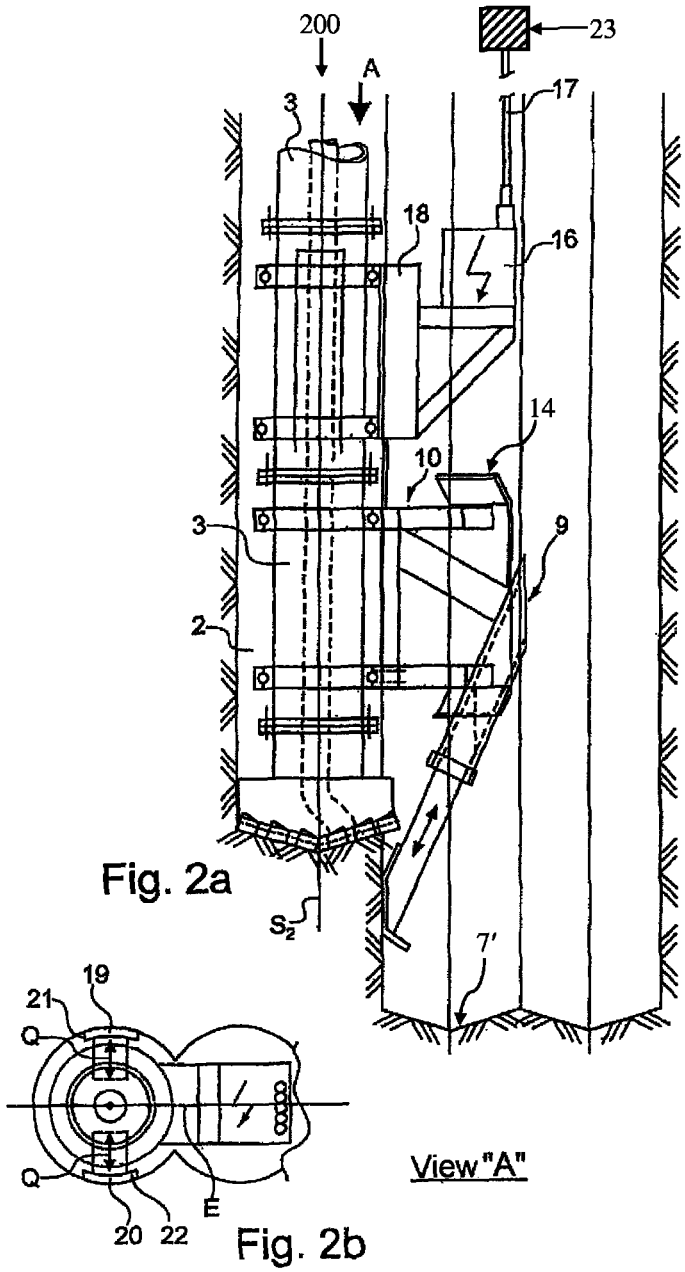
FIG. 2*a*) shows a view corresponding to FIG. 1*a*) of an embodiment of an apparatus according to the present invention.
FIG. 2*b*) shows from above (view A in FIG. 2*a*)) the apparatus according to FIG. 2*a*).

In an embodiment, the present invention provides for device 200 as illustrated in FIGS. 2*a* and 2*b*. In order to avoid repetitions, only the differences from the apparatus 100 discussed with reference to F*igs*. 1*a* and 1*b* will be described hereinafter.

In the apparatus 200, the measuring device 16 is fastened with the aid of a separate carrier 18 which is stationary, above the carrier 10 on the boring rod assembly 3, likewise on the boring rod assembly in the direction of the longitudinal axis S2. Mutually opposing support elements 19, 20, acting radially outward, are provided within the second borehole 2 perpendicularly to the connecting plane E between the two boreholes 1, 2. The support elements are supported on the carrier 18 via actuating elements 21, 22, the length of which can be varied in the direction of the arrows Q.

The actuating elements 21, 22 are connected to a control device 23 to which the measuring device 16 is also connected via the signal lines 17. If the measuring device 16 signals during operation an undesired change in position of the guide device 9 and thus of the boring rod assembly 3, then the support elements 19, 20 are displaced toward the wall of the second borehole with the aid of the actuating elements 21, 22 so as to cause forces in the sense of back displacement of the guide device 9 or the boring rod assembly 3.

In the drawings, the two exemplary embodiments of the apparatus according to the present invention have each been illustrated based on a sequence of three boreholes. It goes without saying that a large number of boreholes, the cross sections of which partially intersect, are produced in building projects for the purpose of producing an impermeable sealing wall. The first borehole in the sense of the foregoing description is then in each case that borehole which adjoins the second borehole made in the ground with the aid of the apparatus according to the present invention.

The present invention is not limited to embodiments described herein; reference should be had to the appended claims.

List of Reference Numerals

100, 200 apparatus
1 first borehole
2 second borehole
3 boring rod assembly
4 boring head
5 channel
6 end face
7 bottom of the borehole
7' bottom of the first borehole
8 boring device
9 guide device
10 carrier
11 opening
12 holder
13 first guide element
14 second guide elements
15 extension arm
16 measuring device
17 signal lines
18 holder
19 support element
20 support element
21 actuating element
22 actuating element
23 control device
E plane
P arrow
S1 longitudinal axis
S2 longitudinal axis
α angle
Q arrow

The invention claimed is:

1. An apparatus for making a second borehole in the ground, a cross section of the second borehole partially intersecting a cross section of an existing first borehole, the second borehole being substantially parallel to the existing first borehole, the apparatus comprising:

a boring device; and a guide device operatively connected to the boring device, the guide device comprising:

a first guide element configured to interact with a first half of a side of a wall of the existing first borehole which is proximal with respect to/nearest to the second borehole when viewed from above, and a second guide element configured to interact with a second half of a side of a wall of the existing first borehole which is distal with respect to/remote from the second borehole when viewed from above, wherein the guide device is configured to guide the boring device relative to the existing first borehole, and wherein the first guide element interacts with the existing first borehole below a bottom of the second borehole as viewed in a drill direction of the second borehole.

2. The apparatus as recited in claim 1, wherein the first guide element is further configured to abut against the wall of the existing first borehole on both sides of a plane connecting longitudinal axes of the existing first borehole and the second borehole.

3. The apparatus as recited in claim 1, wherein the first guide element is further configured to move in a direction having a direction component parallel to the longitudinal axis of the existing first borehole.

4. The apparatus as recited in claim 3, wherein the guide device further comprises a length-variable holder and the first guide element is disposed at a leading end, as viewed in a drift direction, of the length-variable holder.

5. The apparatus as recited in claim 4, wherein the length-variable holder is disposed so that an adjustment direction encloses an acute angle with the longitudinal axis of the existing first borehole.

6. The apparatus as recited in claim 4, wherein the length-variable holder is operated at least one of electrically, pneumatically and hydraulically.

7. The apparatus as recited in claim 4 wherein the length-variable holder includes a length adjuster configured to receive a spring force so as to press the first guide element against the wall of the existing first borehole.

8. The apparatus as recited in claim 1, further comprising a measuring device configured to detect a position of the guide device in the existing first borehole.

9. The apparatus as recited in claim 8, wherein the measuring device is at least one of an electronic inclinometer and a laser gyro.

10. The apparatus as recited in claim 1, wherein the boring device includes a rotationally driven boring head and a control device configured to affect a rotary drive.

11. The apparatus as recited in claim 10, further comprising a measuring device configured to detect a position of the guide device in the existing first borehole, the measuring device being operatively connected to the control device.

12. The apparatus as recited in claim 10, wherein the apparatus further comprises support elements and actuating elements, the support elements being configured to act on the boring device and to be brought into abutment with the wall of the second borehole in a direction running transversely to a connecting plane by the actuating elements, wherein the control device is connected to the actuating elements and to the measuring device.

13. A method for making a second borehole in the ground, a cross section of the second borehole partially intersecting a cross section of an existing first borehole, the second borehole being substantially parallel to the existing first borehole, the method comprising:

making a first borehole so as to provide the existing first borehole;

making the second borehole with an apparatus comprising:

a boring device, and a guide device operatively connected to the boring device, the guide device comprising:

a first guide element configured to interact with a first half of a side of a wall of the existing first borehole which is proximal with respect to/nearest to the second borehole when viewed from above, and a second guide element configured to interact with a second half of a side of a wall of the existing first borehole which is distal with respect to/remote from the second borehole when viewed from above, wherein the guide device is configured to guide the boring device relative to the existing first borehole, wherein the boring device is guided by an interaction of the guide device on the wall of the existing first borehole, and wherein the first guide element interacts with the existing first borehole below a bottom of the second borehole as viewed in a drill direction of the second borehole.

14. The method as recited in claim 13, wherein the boring device includes a rotationally driven boring head and wherein the guide device is configured to pivot about a longitudinal axis, wherein the apparatus is further configured to change a rotary drive direction for generating a moment acting in a return pivot direction when the guide device pivots about the longitudinal axis of the existing first borehole.

15. The method as recited in claim 13, wherein the apparatus further comprises support elements, and wherein, upon a pivoting of the guide device about a longitudinal axis of the existing first borehole, the apparatus is configured to create a force acting in a return pivot direction on the support elements so as to press the support elements against a wall of the second borehole.

* * * * *